US005293671A

United States Patent [19]

Oda

[11] Patent Number: 5,293,671

[45] Date of Patent: Mar. 15, 1994

[54] SLIDER FOR CLOSING COUPLING ELEMENTS

[75] Inventor: Kiyoshi Oda, Toyama, Japan

[73] Assignee: Yoshida Kogyo K.K., Tokyo, Japan

[21] Appl. No.: 10,187

[22] Filed: Jan. 28, 1993

[30] Foreign Application Priority Data

Feb. 27, 1992 [JP] Japan ..... 4-9321[U]

[51] Int. Cl.[5] ..... A44B 19/00

[52] U.S. Cl. ..... 24/429; 24/419; 24/587

[58] Field of Search ..... 24/429, 419, 436, 437, 24/576, 587

[56] References Cited

U.S. PATENT DOCUMENTS

| | | | |
|---|---|---|---|
| 1,910,404 | 5/1933 | Prentice | 24/436 |
| 3,555,627 | 1/1971 | Howell . | |
| 3,854,175 | 12/1974 | Yoshida . | |
| 3,955,248 | 5/1976 | Akashi . | |
| 4,513,484 | 4/1985 | Iblings | 24/429 |
| 4,941,238 | 7/1990 | Clark | 24/587 |
| 5,067,209 | 11/1991 | Terada et al. | 24/429 |
| 5,093,966 | 3/1992 | Yukl et al. | 24/429 |

FOREIGN PATENT DOCUMENTS

| | | | |
|---|---|---|---|
| 792705 | 1/1936 | France . | |
| 2205288 | 5/1974 | France . | |
| 2272621 | 12/1975 | France . | |
| 0553551 | 5/1943 | United Kingdom | 24/436 |
| 0557860 | 12/1943 | United Kingdom | 24/419 |

*Primary Examiner*—Victor N. Sakran

*Attorney, Agent, or Firm*—Hill, Steadman & Simpson

[57] ABSTRACT

A slider for closing a coupling device, comprising: a slider body having a central guide for guiding male and female coupling elements of the coupling device, and a coupling guide channel; and a C-shape puller pivotally connected at its base to a front end of the slider body so as to be free in motion in a horizontal plane, there being a gap between the body and the puller.

7 Claims, 6 Drawing Sheets

SLIDER FOR CLOSING COUPLING ELEMENTS

BACKGROUND OF THE INVENTION

1. Field of the Invention

This invention relates to a slider for closing the male and female elements of a coupling device for a tube containing a bundle of wires or for closing a slide fastener attached to the end of a sheet or the like.

2. Description of the Related Art

Conventionally, a jig in the form of pincers or the like was used to close a tubular structure containing bundles of wires which structure includes a coupling device composed of male and female elements, as opposed to a slider.

The way of connecting sheets with a slide fastener, whereby the slider body is comprised of a coupling guide channel for guiding the coupling elements during their vertical motion and a horizontal central guide, and a puller pivotally attached to the slider body, is well known. (Japanese Utility Model Publication No. SHO 47-36002).

Moreover, a slider construction whereby, for example, a pin is inserted in a hole which has in turn been made in a protrusion on the lower wing of a slider body so as the slide fastener can be closed with a sliding operation, as opposed to a set up where a puller is attached to the slider body, is also well known. (Japanese Utility Model Publication No. SHO 50-31126).

The first-named conventional art employs a jig using; for example, pincers for the coupling device as opposed to a slider comprised of male and female coupling elements, so as this is not a specialized jig, the operation efficiency is very poor.

Also, in the prior art disclosed in the first-named publication, a slider is employed which joins the overlapping ends of a waterproof sheet used in construction or the like, so this kind of slider cannot be used to join the protruding ends of a sheet from both the left and right sides. Naturally this restricts the scope of use. Additionally, on guiding the edge of the slide fastener chain into the guide channel of the slider body it is necessary to guide and interlock the coupling elements from the upper and lower sides whereas in usual slide fasteners the slide fastener chain fastener elements are designed so as to be guided in both lateral directions meaning that in the special interlocking method in this example the interlocking operation cannot be smooth.

Moreover, in the second-named publication, there is no puller. However, this kind of fastener uses a concealed slider, the type is different and in addition to this there is an hole in the protruding portion of the lower wing coming from the forward surface of the slider body. So, as the puller is a stationary type which is different again from the pivoting type of slider, the sliding operation is not smooth and the scope of use is of course restricted.

SUMMARY OF THE INVENTION

Accordingly an object of this invention is to propose a solution to the above problems by presenting a slider with a very simple construction utilizing male and female coupling elements which opens and closes in a very smooth manner whereby the existence of a puller does not become an obstacle and provides for convenient handling of the sliding of the slider elements within the slide fastener chain.

The aforementioned object is accomplished by a slider for closing a coupling device, comprising: a slider body having a central guide for guiding male and female coupling elements of the coupling device, and a coupling guide channel; and a generally C-shape puller pivotally connected at its base to a front end of said slider body so as to be free in pivotal motion in a horizontal plane, there being a gap between said body and the puller.

A recess is then formed at the front end of the slider body so as to regulate the swinging action of the slider for closing within a fixed region of the the pivot. Also, the coupling elements are coupled together within a fixed horizontal plane.

In order to explain the slider for closing the coupling device in this invention it is first necessary to explain the construction of the coupling device formed from male and female coupling elements.

The male and female coupling elements enter the guide channels of the slider body from the front end, then, as shown in FIG. 3, when the puller is pulled upwards via an attached thread or the like the male and female coupling elements from the lower mouth of the slider body coupled together. When the coupling elements have been coupled along their whole lengths, the slider can finally be removed from the end of the coupling elements and can be used for the closing operation for a new set of coupling elements. This slider can also be used as a jig for closing a coupling device or a slide fastener.

DETAILED DESCRIPTION

Figure 1:
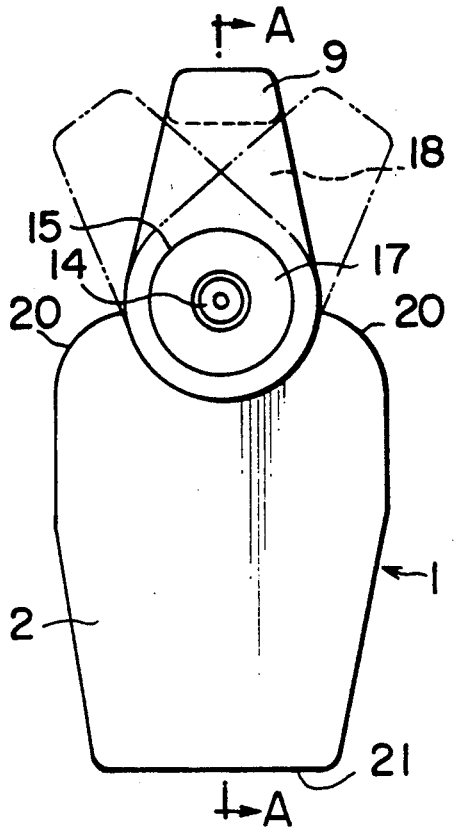
FIG. 1 is a plan view of a slider, for closing coupling elements, according to a first embodiment.
Figure 2:
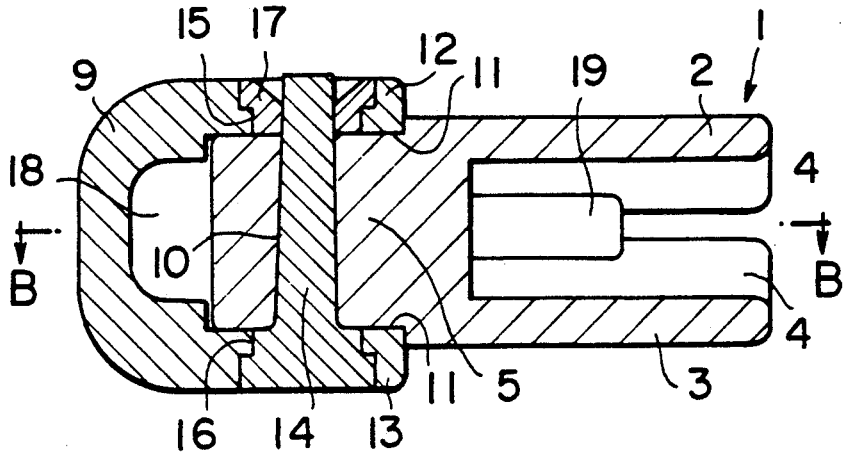
FIG. 2 is a cross-sectional view taken along line A—A of FIG. 1.
Figure 3:
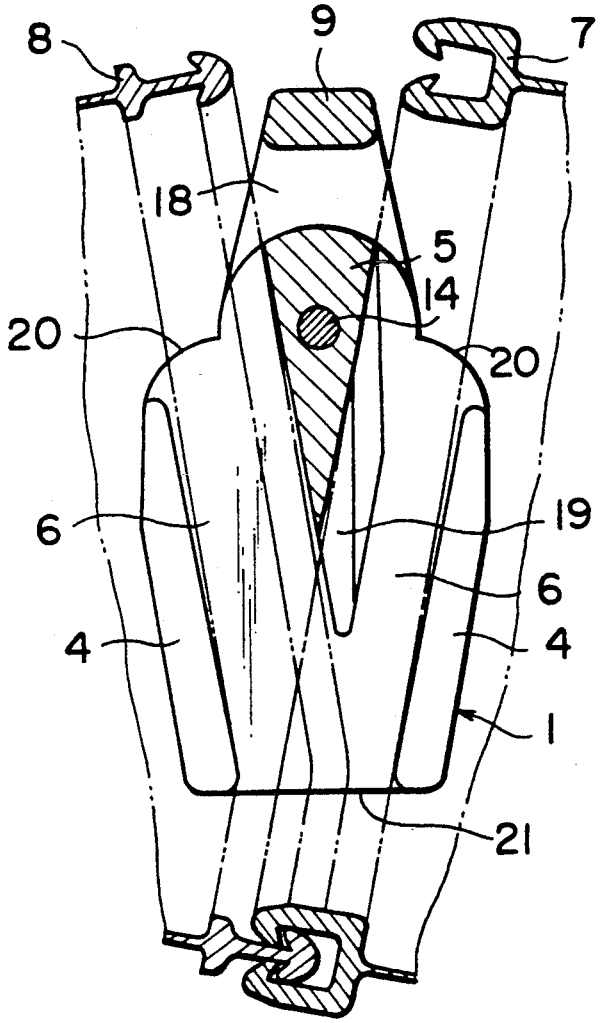
FIG 3 is a cross-sectional view taken along line B—B of FIG. 2, the coupling elements shown by imaginary lines.

Preferred embodiments of a slider used for closing a coupling device will now be described in detail with reference to the accompanying drawings.

FIGS. 1 to 4 show a first embodiment of the slider used for closing the coupling elements in this invention. This slider is used with a coupling device composed of male and female coupling elements. The slider body 1 is composed of two flanges 4 attached to the upper and lower sides of the upper and lower wings 2 and 3, respectively, with the central guide 5 also being sandwiched between the upper and lower wings 2 and 3 at the central region of the front end of a puller body. These elements together then form the coupling guide channel 6 with the female coupling element 7 being inserted into one side of the coupling guide channel 6 and the male coupling element 8 being inserted into the other side of the coupling guide channel 6.

The puller body has a protruding portion at the central part of its front end, with the inverted C-shape puller 9 pivotally mounted at this protruding portion. A through hole 10 is made within the central guide 5 of the slider body 1 and recesses 11 are formed in the regions of the upper 2 and lower 3 wings which surround this through hole. The puller 9 can then swing within a fixed horizontal plane like, for example a fixed horizontal plane such as the one indicated by the dotted lines shown in FIG. 1. A pin 14 is then inserted via the guides 15 and 16 into the thin region of both ends 12 and 13 of the puller 9. A locking washer 17 is then inserted into the opposing guide 15. The pin 14 is guided by its lower guide 16, and the front end of the pin 14 is locked via the washer 17. The puller 9 can thus pivot about the slider body 1 and a gap 18 is created between the front end of the slider body 1 and the puller 9. Also, according to the diagrams, 19 designates a central guide; 20, a slider shoulder opening; and 21, a lower opening.

Figure 4:
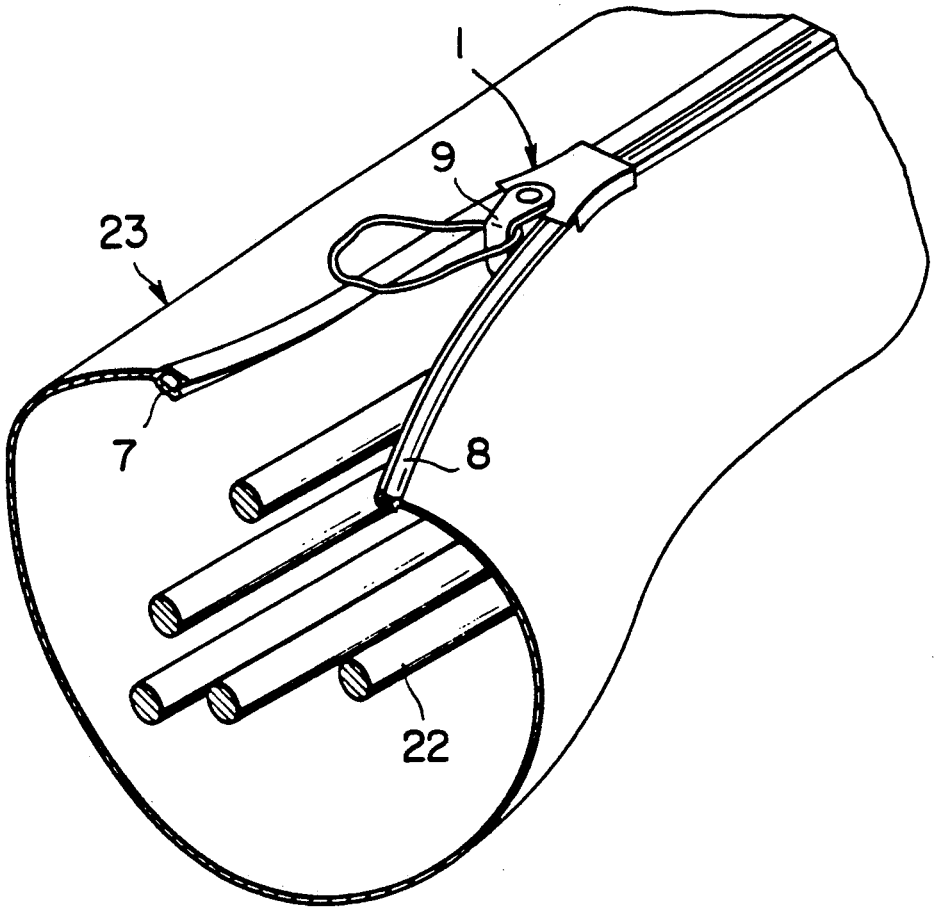
FIG. 4 is a fragmentary perspective view of an example in which this invention is applied to a tube for a bundle of wires.

The female coupling element 7 is inserted into the coupling guide channel 6 via the shoulder opening 20 on one side of the slider body 1, and the male coupling element 8 is inserted into the coupling guide channel 6 via the other shoulder opening 20 of the slider body 1. The male and female coupling elements 7 and 8 are then coupled together and come out of the slider body 1 via the lower opening 21. The slider is then slid to the end of the male and female coupling elements, thus coupling them together, and is then detached at the ends. For example, as shown in FIG. 4, by using the slider, both edges of a tube 23 for holding in place a bundle of wires 22 having male and female coupling elements 7 and 8, can be joined along their entire length.

Figure 5:
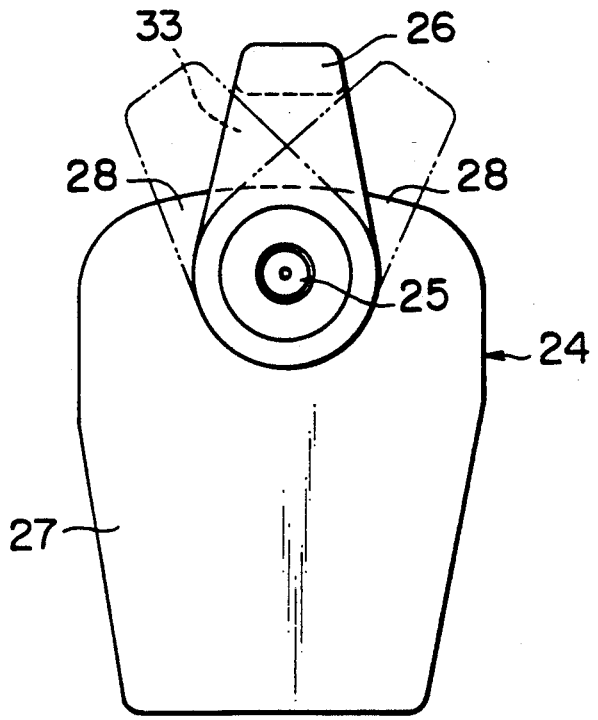
FIG. 5 is a plan view of a slider, for closing coupling elements, according to a second embodiment.
Figure 6:
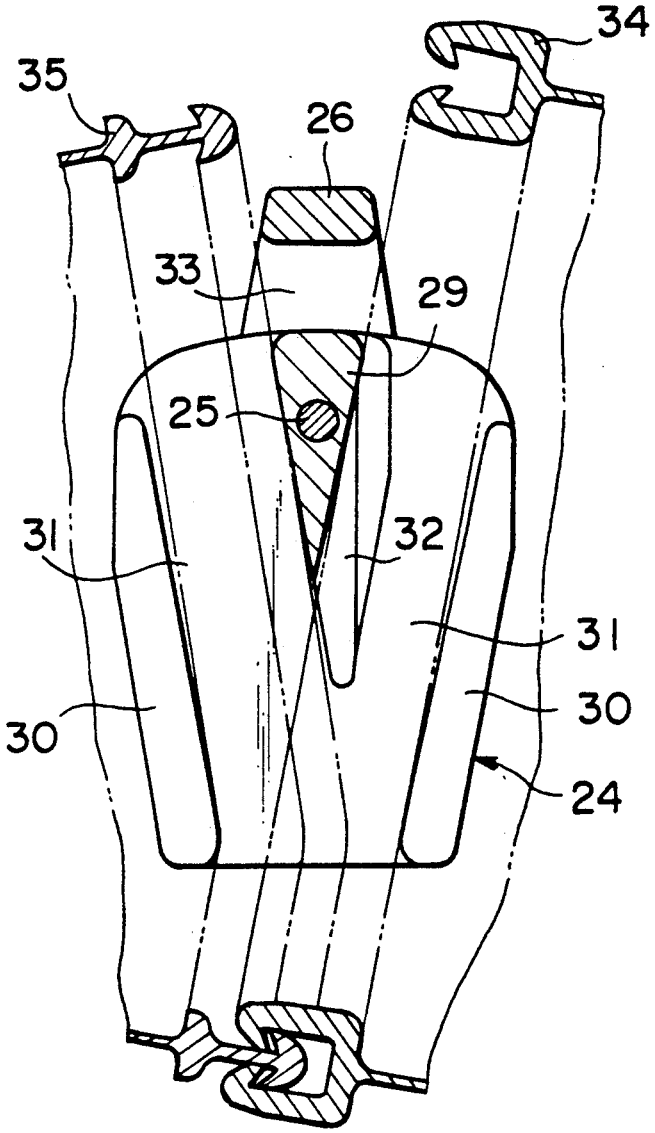
FIG. 6 is a cross-sectional outline view of the slider in FIG. 5.

Following is an explanation of the slider shown in FIGS. 5 and 6. On the whole, this has the same form as the first embodiment, but there is the following difference. There is no protrusion at the front end of the slider body 24. As a result of this, as shown in FIG. 5, the degree to which the puller 26 can pivot into the recess 28 in the upper wing 27 has been greatly increased. This is of course the same for the lower wing. Other than this the form is much the same as for the first embodiment, where 29 is a central guide, 30 and 30 are flanges, 31 and 31 are guide channels, 32 is a guide, and 33 is a gap.

Also, as the way in which this slider is used is exactly the same as the first example, it is therefore suitable for coupling equipment having male and female coupling elements. For example, as shown in FIG. 6, The female coupling element 34 is inserted into one side of the coupling guide channel 31 and the male coupling element 35 is inserted into the other side of the coupling guide channel 31. The male and female coupling elements 34 and 35 are coupled together and then come out of the slider body 24.

Figure 7:
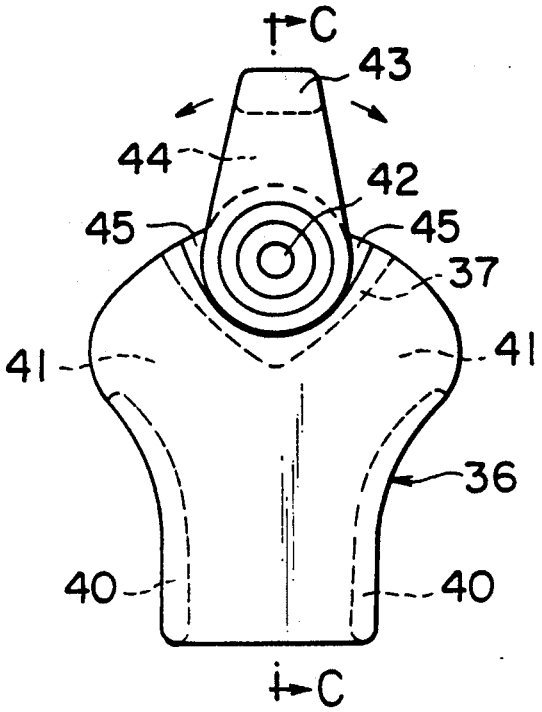
FIG. 7 is a plane view of a slider, for closing coupling elements, according to a third embodiment.
Figure 8:
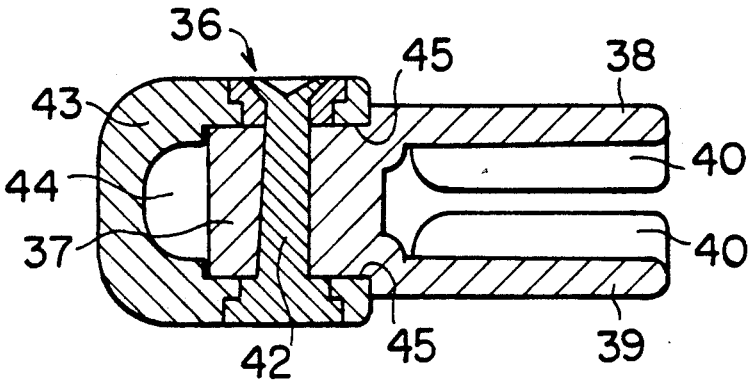
FIG. 8 is a cross-sectional view taken along line C—C of FIG. 7.

Finally, the slider shown in FIGS. 7 and 8 will be described. This slider differs from those in the first and second embodiments in that it is a slider to be used in ordinary slide fasteners, although it's construction is substantially the same as those embodiments. The slider body 36 is composed of a central guide 37, upper and lower wings 38 and 39, flanges 40 and 40 and coupling guide channels 41 and 41. A pin 42 is inserted through the central guide 37, and a C-shape puller 43 pivots, and is slidable within a horizontal plane at the front end of the slider body 36. Moreover, recesses 45 are created in the upper and lower wings 38 and 39 and a gap 44 is formed at the front surface of the slider body, both in order to restrict the swinging operation of the puller 43.

The way in which this slider is used is also the same as the former examples. Here, one part of the fastener chain is inserted into one side of the coupling guide channel 41, and the other side of the fastener chain is inserted into the other side of the coupling guide channel 41. The slider can then be slid by fastening, for example, a thread to the puller 43. After the parts of the fastener chain have been joined together, the slider can be removed from the fastener chain to be used again.

The construction of the slider for closing in this invention is as that explained above. The result of this construction is as follows.

The slider in this invention has an inverted-shape pivoting puller at the front end of a slider body composed of a central guide and coupling guide channels, with the puller being slidable within a horizontal plane. The slider for closing coupling elements also has a gap between the puller and the slider body, thus giving a simple structure whereby the puller swings within a horizontal plane with respect to the puller body. Moreover, as there is the gap, even the pulling of the slider in various directions during the sliding operation will be coped with in the most efficient manner. For example, in order to cope with pulling in a horizontal plane and pulling in a vertical plane, with this kind of swinging operation for the puller, by hooking, for example, a piece of thread to the puller opening a slider which is suitable for applications where it will be pulled in all directions can be attained. It is therefore also possible to employ this in a simple manner to connect a sheet used for construction in the second known publication.

Additionally, by providing a recess in the region surrounding the pivot of the slider body, the swinging operation of the puller be restricted. Therefore, during the operation to thread coupling elements or fastener chain through the slider body the puller does not become an obstruction giving the effect that the efficiency of the input operation can be greatly improved.

What is claimed is:

1. A slider for closing a coupling device, comprising:

a slider body having upper and lower wings and a central guide therebetween for guiding male and female coupling elements of the coupling device between the upper and lower wings, and a coupling guide channel between the upper and lower wings from a front end of said slider body to a back end of said slider body; and a C-shape puller pivotally at its base to said front end of said slider so as to be free in pivotal motion in a horizontal plane, said C-shape puller arranged vertically, spanning between said upper ad lower wings there being a gap between said body and the puller.

2. A slider according to claim 1, wherein a recess is formed in a circumferential surface of a pivot, which is supported at the front end of said body, for restricting pivotal motion of said puller to a predetermined extent.

3. A slider according to claim 2, wherein the male and female coupling elements are coupled together within a horizontal plane.

4. A slider according to claim 1, wherein the male and female coupling elements are coupled together within a horizontal plane.

5. A slider according to claim 1, wherein said C-shape puller is pivotably connected to said slider body by a pin member held within an aperture through the slider body and connected on opposite ends to opposite tines of said C-shaped puller.

6. A slider according to claim 5, wherein said tines of said C-shaped puller are rounded n a horizontal plane and interfit within a recess on outer surfaces of said upper and lower wings, said recesses having sidewalls which limit the pivoting movement of said C-shape puller with respect to said slider body.

7. A slider according to claim 5, wherein at least one of said tines is rounded, and at least one of said upper and lower wings provides a recess wherein said rounded tine interfits therein, and said recess provides a side wall for limiting the pivoting movement of said C-shape puller with respect to said slider body.

* * * * *